US005951380A

United States Patent [19]

Kim

[11] Patent Number: 5,951,380

[45] Date of Patent: Sep. 14, 1999

[54] POLISHING APPARATUS FOR A SEMICONDUCTOR WAFER

[75] Inventor: Young-Soo Kim, Nonsan-gun, Rep. of Korea

[73] Assignee: LG Semicon Co.,Ltd., Chungcheongbuk-do, Rep. of Korea

[21] Appl. No.: 08/995,007

[22] Filed: Dec. 19, 1997

[30] Foreign Application Priority Data

Dec. 24, 1996 [KR] Rep. of Korea ..... 96-71486

[51] Int. Cl.[6] ..... B24B 7/00; B24B 29/00

[52] U.S. Cl. ..... 451/65; 451/288; 451/495; 451/529; 451/550

[58] Field of Search ..... 451/41, 59, 65, 451/259, 285, 288, 289, 290, 461, 495, 527, 529, 537, 550

[56] References Cited

U.S. PATENT DOCUMENTS

| | | | |
|---|---|---|---|
| 3,731,436 | 5/1973 | Krafft | 451/550 |
| 4,715,150 | 12/1987 | Takeuchi et al. | 451/527 |
| 5,212,910 | 5/1993 | Breivogel et al. . | |
| 5,297,364 | 3/1994 | Tuttle | 451/527 |
| 5,389,032 | 2/1995 | Beardsley | 451/461 X |
| 5,558,563 | 9/1996 | Cox et al. | 451/527 X |
| 5,567,503 | 10/1996 | Sexton et al. | 451/527 X |
| 5,578,362 | 11/1996 | Reinhardt et al. | 451/527 X |
| 5,609,517 | 3/1997 | Lafaro | 451/529 |
| 5,785,584 | 7/1998 | Marmillion et al. | 451/495 X |

*Primary Examiner*—Timothy V. Eley

[57] ABSTRACT

A polishing method and apparatus thereof that selectively or continuously uses multiple kinds of polishing materials which have different polishing characteristics. The polishing materials used are based on appropriate polishing requirements of the object polished. In addition, the polishing rate and uniformity rate can be enhanced by arranging the polishing materials based on their degree of their polishing characteristics.

14 Claims, 2 Drawing Sheets

POLISHING APPARATUS FOR A SEMICONDUCTOR WAFER

BACKGROUND OF THE INVENTION

1. Field of the Invention

The present invention relates to planarizing a surface of a semiconductor wafer, and more particularly, to a polishing method and apparatus thereof, which satisfies multiple polishing requirements, for polishing the surface of a semiconductor wafer.

2. Discussion of Related Art

Generally, a semiconductor device requires a process for accumulating multiple layers on a semiconductor wafer. In such a process for high integration, it is desirable for a semiconductor device to be made in a limited space. Thus, planarization of a semiconductor wafer surface having multiple layers is an important process and an important parameter in increasing process yields.

A typical method for the planarization of a semiconductor wafer is a Chemical Mechanical Polishing (hereinafter referred to as CMP) method.

A typical CMP apparatus for a semiconductor wafer includes a carrier for holding the semiconductor wafer. Also, the typical CMP apparatus includes a polishing table having a polishing pad. The polishing pad contains a polishing material. The surface of the semiconductor wafer is polished by friction caused by moving the surface of the semiconductor wafer against the surface of the polishing pad having the polishing material. In addition, the more abrasive the polishing material is, the easier the surface of the semiconductor can be polished.

There have been structural improvements to the typical CMP apparatus for enhancing uniformity rate and polishing rate. Such structural improvements are related to the structure of the polishing pad that makes contact with the surface of the semiconductor wafer. One such structural improvement is illustrated in U.S. Pat. No. 5,212,910. The structural improvement is related to the polishing pad structure having complex materials with complex characteristics to improve polishing performance. FIG. 1 shows a cross-sectional structure of the prior art polishing pad of U.S. Pat. No. 5,212,910 used for a CMP apparatus.

As shown in FIG. 1, the prior art polishing pad 11 is formed on a polishing table 10. The polishing pad 11 comprises a first layer 20 composed of an elastic material such as a sponge, and a second layer 22 on the first layer 20. The second layer 22 is divided into sections of a hard material and predetermined empty spaces 29. The polishing pad 11 also comprises a third layer 23 formed on the second layer 22. The third layer 23 is made of a hard material that is used with a polishing solution to polish the surface of the semiconductor wafer.

The semiconductor wafer is polished as a result of the friction caused when the polishing pad 11 rubs against the top surface of the semiconductor wafer. By having the polishing pad 11 on the polishing table 10, the polishing table 10 rotates the polishing pad 11 that causes the polishing pad 11 to rub against the top surface of the semiconductor wafer. Thus, the friction caused from the rubbing action polishes the top surface of the semiconductor wafer. Polishing solution, which is optional, may be applied to the surface of the semiconductor wafer to enhance the polishing process.

However, the top layer of the polishing pad of the prior art, which makes contact with the surface of the semiconductor wafer, comprises of only one type of polishing material. Thus, there are limits in improving the polishing characteristics of one type of polishing material. Also, when a layer formed on the surface of the semiconductor wafer comprises of multiple materials, the polishing pad must satisfy multiple polishing requirements. Thus, having one type of polishing material is deficient for a polishing pad. Further, a polishing pad with one type of polishing material and characteristic is not suitable for satisfying multiple polishing requirements of semiconductor wafers.

Therefore, the polishing pad, which comprises of a top layer of one type of polishing material, cannot properly polish a surface of a semiconductor wafer that requires a different polishing characteristic than the polishing characteristic of the top layer. Thus, in order to solve the difference in polishing characteristics, a new polishing pad with a different top layer having a different polishing material is required. As a result, polishing pads must be replaced on a polishing table, which reduces operation efficiency.

SUMMARY OF THE INVENTION

Accordingly, the present invention is directed to a polishing method and an apparatus thereof that substantially obviates one or more of the problems due to limitations and disadvantages of the prior art.

An object of the present invention is to provide a polishing method and an apparatus thereof that improves polishing characteristics of a polishing pad.

Another object of the present invention is to provide a polishing method and an apparatus thereof that is capable of polishing a surface of a semiconductor wafer satisfying multiple polishing requirements using a single polishing pad.

A further object of the present invention is to provide a method and apparatus thereof that is capable of polishing a surface of a semiconductor wafer without removing polishing pads from a polishing table.

To achieve these and other objects and in accordance with the purpose of the present invention, as embodied and broadly described, there is provided a polishing method including the steps of: selecting at least a first and a second polishing material among multiple polishing materials, the first polishing material having a polishing characteristic different than the second polishing material, to satisfy polishing requirements of a surface of a semiconductor wafer; providing a polishing pad; arranging the polishing pad into at least a first area and a second area, the first area having the first polishing material and the second area having the second polishing material; disposing the first polishing material on the first area; disposing the second polishing material on the second area; and polishing the surface of the semiconductor wafer with the polishing pad.

In another aspect of the present invention, there is provided a polishing pad which includes: at least a first and second polishing material, the first polishing material having a polishing characteristic different than the second polishing material; and a pad arranged into at least a first area and a second area, the first area having the first polishing material and the second area having the second polishing material.

In still another aspect of the present invention, there is provided a polishing apparatus which includes: a polishing table; and a first part on the polishing table, the first part including, at least a first and second polishing material, the first polishing material having a polishing characteristic different than the second polishing material, and a first polishing pad arranged into at least a first area and a second area, the first area having the first polishing material and the second area having the second polishing material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE ATTACHED DRAWINGS

The present invention will become more fully understood from the detailed description given hereinbelow and the accompanying drawings which are given by way of illustration only, and thus are not limitative of the present invention, and wherein:

FIG. 1. shows a cross-sectional view of a prior art polishing pad.

DETAILED DESCRIPTION OF PREFERRED EMBODIMENT

Reference will now be made in detail to the preferred embodiments of the present invention, examples of which are illustrated in the accompanying drawings.

Figure 1:
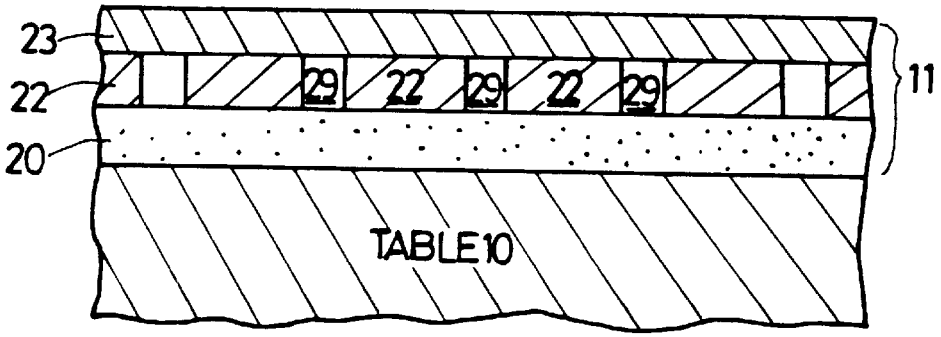
FIG.1 (Prior Art)
Figure 2:
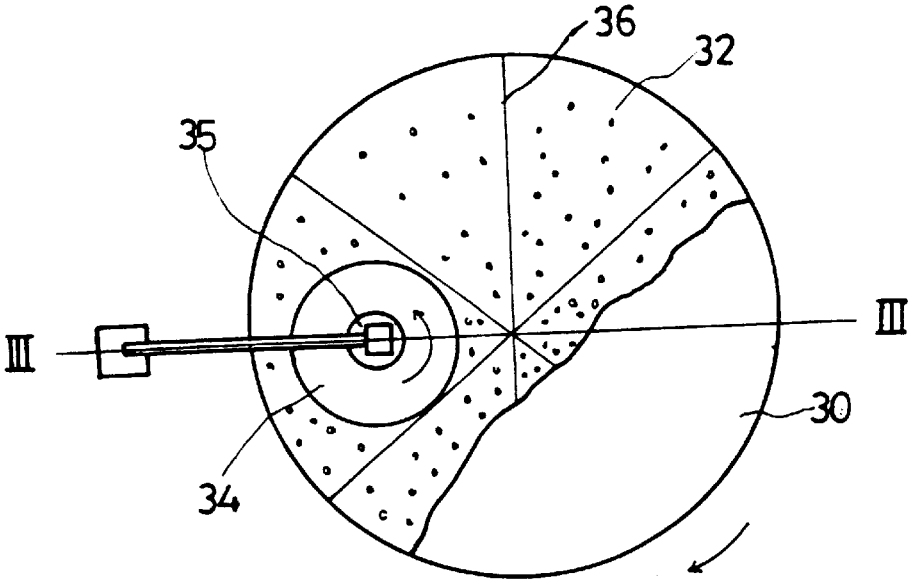
FIG. 2 is a plan view of a first preferred embodiment of a polishing apparatus according to the present invention.
Figure 3:
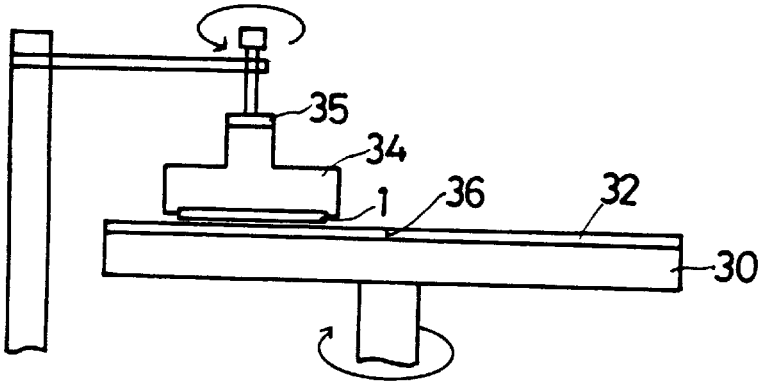
FIG. 3 is a cross-sectional view of the polishing apparatus taken along the line III—III of FIG. 2.

As shown in FIG. 2, a first preferred embodiment of the present invention illustrates a mechanical polishing apparatus. The mechanical polishing apparatus includes a polishing table 30 which can rotate in a clockwise or counter-clockwise direction, a polishing pad 32 on the polishing table 30. Also included is a carrier head 35 and carrier 34 above the polishing table 30. The carrier head 35 adheres to the carrier 34, and the carrier head 35 is able to rotate the carrier 34. The carrier 34 holds onto a semiconductor wafer 1 (as shown in FIG. 3) and is able to rotate the semiconductor wafer 1. The polishing pad 32 is divided into several parts that are, preferably, divided into pie shaped sections. Also on the polishing pad 32 are grooves 36. The preferred embodiment of FIG. 2 has at least two parts or pie sections having different polishing characteristics. In addition, each part or pie section may contain multiple polishing materials with different polishing characteristics.

Referring to FIG. 3, a cross-sectional view taken along the line III—III of FIG. 2 is illustrated.

In FIG. 3, the polishing table 30 is able to rotate in a clockwise or counter-clockwise direction. The polishing pad 32 on the polishing table 30 contains grooves 36. The grooves 36 are, preferably, disposed in between parts of sections of the polishing pad 32. A semiconductor wafer 1 is attached to the carrier 34 which is attached to the carrier head 35. The carrier head 35 is capable of rotating the carrier 34 in a clockwise or counter-clockwise direction, thus, causing the semiconductor wafer 1 to rotate accordingly.

Referring to FIGS. 2 and 3, the operation of the first preferred embodiment will be explained. The polishing pad 32 is composed of multiple kinds of materials. Each kind of the material has a different polishing characteristic than the other. Polishing is, thus, performed when the polishing table 30 rotates the polishing pad 32 thereon having multiple polishing materials, and the carrier head 35 rotates the carrier 34 holding the semiconductor wafer 1. Specifically, the surface of the polishing pad 32 rubs against the surface of the semiconductor wafer 1 because of their respective rotating motion. Because of the friction caused by the rotation of the polishing pad 32 and the semiconductor wafer 1, the polishing materials on the polishing pad 32 can polish the surface of the semiconductor wafer 1 based on their respective polishing characteristics. Thus, multiple polishing requirements can be satisfied for the semiconductor wafer 1 using the polishing pad 32. A polishing solution may also be added to the process to enhance the polishing of the surface of the semiconductor wafer 1.

Also, the plurality of small grooves 36 allow for contaminants to be easily removed from the surface of the wafer during the polishing process 35 thereby providing for a more clean and uniform polishing process.

In addition, the divided parts or sections of the polishing pad 32 are composed, preferably, of materials that are different in polishing characteristics that can enhance polishing rate and uniformity rate. The polishing rate and uniformity rate can be enhanced in the following ways. First, materials on the polishing pad can be arranged on the divided parts or sections based on its degree of roughness. For instance, the materials can be arranged from the roughest material to the smoothest material or vice versa. Second, materials on the polishing pad can be arranged on the divided parts or sections based on its degree of hardness. For instance, the materials can be arranged from the hardest material to the softest material or vice versa. The present invention is not limited to just roughness and hardness degree, but can be arranged according to any polishing characteristic degree.

Accordingly, a single polishing pad having multiple polishing characteristics can satisfy multiple polishing requirements for a semiconductor wafer.

Figure 4:
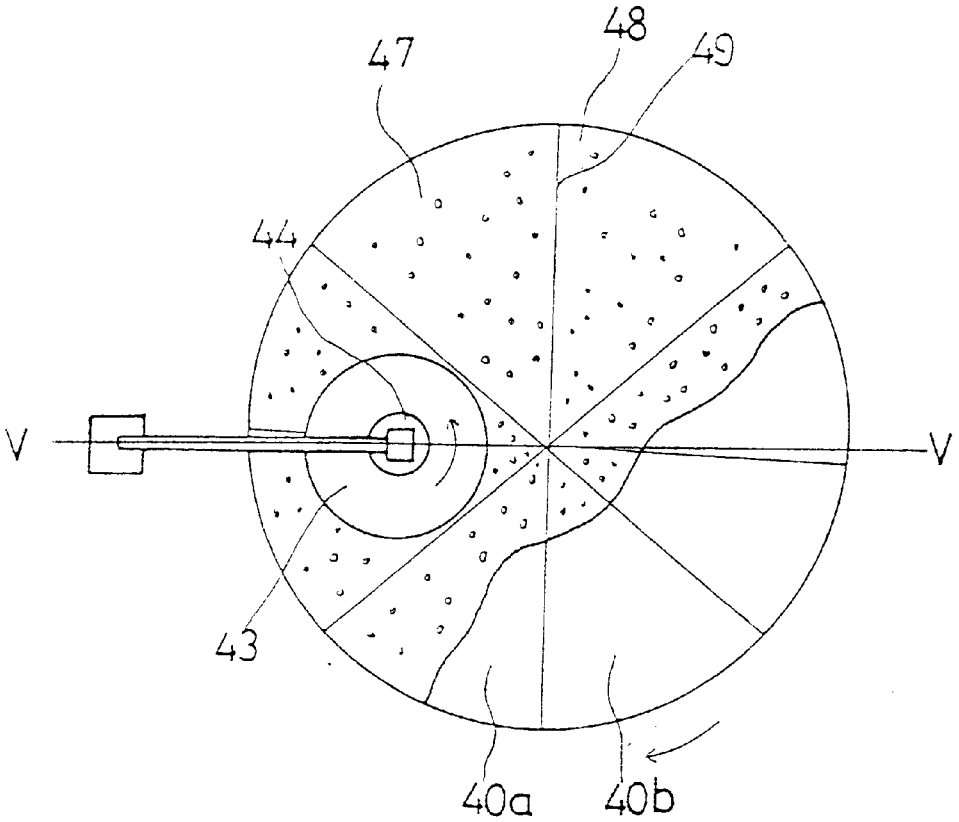
FIG. 4 is a plan view of a second preferred embodiment of the polishing apparatus according to the present invention.
Figure 5:
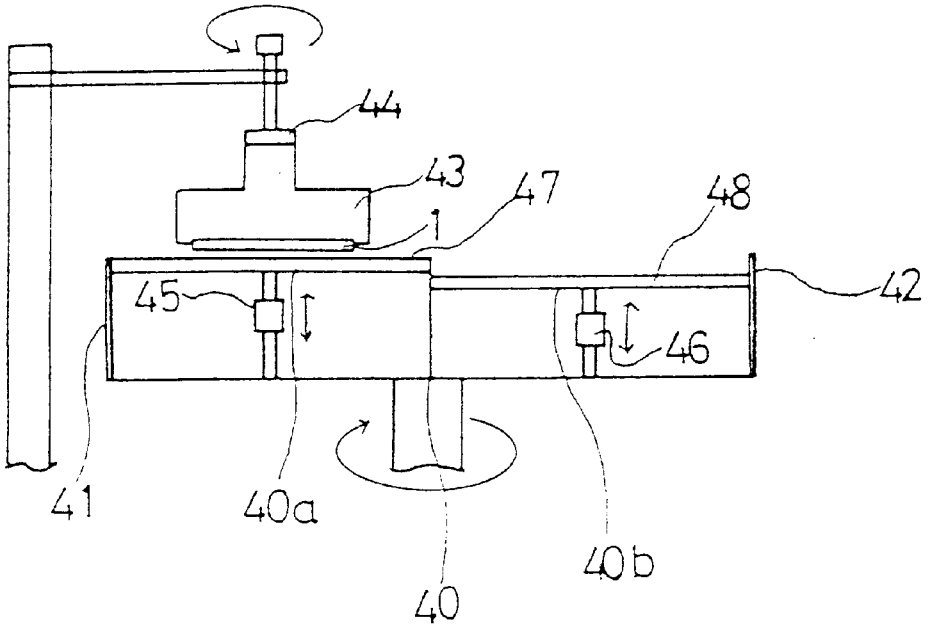
FIG. 5 is a cross-sectional view of the polishing apparatus taken along the line V—V of FIG. 4.

As depicted in FIGS. 4 and 5, a second embodiment of the present invention of a polishing apparatus is illustrated. As shown in FIG. 4, a polishing table 40*a* (for a first part 41 as shown in FIG. 5) with a polishing pad 47 thereon is illustrated. The structure of FIG. 4 is similar to the structure of FIG. 2 showing grooves 49. The polishing pad 47 of FIG. 4 has the same operation as the polishing pad 32 of FIG. 2.

Referring to FIG. 5, the second embodiment of the polishing apparatus includes a polishing table 40 having a first part 41 and a second part 42, a carrier 43 for grabbing a semiconductor wafer 1, and a carrier head 44 attached to the carrier 43 that rotates the carrier 43 and semiconductor wafer 1. The first part 41 includes a first polishing pad 47 disposed on a first table 40*a* and a first slider 45. The first slider 45 lowers or raises the first polishing pad 47. The second part 42 includes a second polishing pad 48 disposed on a second table 40*b* and a second slider 46. The second slider 46 lowers or raises the second polishing pad 48.

Both the first polishing pad 47 and second polishing pad 48 are similar in structure to the polishing pad 32 of FIG. 2 and have the same polishing operation.

Referring to FIGS. 4 and 5, the operation of the second embodiment will now be explained. Preferably, the first polishing pad 47 and second polishing pad 48 have different materials thereon with different polishing characteristics. Thus, the first polishing pad 47 and the second polishing pad 48 can polish the semiconductor wafer 1 according to their respective polishing characteristics. The polishing process is thus performed in a similar manner as to the first preferred embodiment of FIGS. 2 and 3. That is, if a different polishing pad with different polishing characteristics is required than, e.g., the first polishing pad 45, the first slider 47 can lower the first polishing pad 47. Then the polishing table 40 rotates the second part 42 to place the second polishing pad 48 underneath the semiconductor wafer 1. The second slider 46 then raises the second polishing pad 48 to begin polishing the semiconductor wafer 1. In this process, a new polishing pad does not need to be placed on a polishing table, but rotates the first part or second part to place the desired polishing pad underneath the semiconductor wafer 1 to polish the semiconductor wafer.

Accordingly, the unnecessary polishing pad can be lowered so that another polishing pad can be selectively used in accordance with the polishing characteristics required by the semiconductor wafer 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A polishing pad comprising:

at least a first and second polishing material, a polishing characteristic of said first polishing material being different than a polishing characteristic of said second polishing material; and a pad arranged into at least a first sector and a second sector, the first sector having the first polishing material and the second sector having the second polishing material.

2. The polishing pad of claim 1, wherein the pad includes a plurality of radial grooves that border said first and second sectors.

3. The polishing pad of claim 1, wherein each polishing characteristic corresponds to a different material on a surface of a semiconductor wafer.

4. The polishing pad of claim 1, wherein a plurality of polishing materials, each polishing material having a different polishing characteristic, are alternately formed on areas of the pad.

5. The polishing pad of claim 1, wherein the polishing characteristics of said first and second polishing materials are at least one of a smooth and rough polishing characteristic.

6. The polishing pad of claim 1, wherein the polishing characteristics of said first and second polishing materials are at least one of a hard and soft polishing characteristic.

7. A polishing apparatus comprising:

a polishing table; and a first part on the polishing table, the first part including, at least a first and second polishing material, a polishing characteristic of said first polishing material being different than a polishing characteristic of said second polishing material, and a first polishing pad arranged into at least a first sector and a second sector, the first sector having the first polishing material and the second sector having the second polishing material.

8. The polishing apparatus of claim 7, further comprising:

a second part on the polishing table, the second part including, at least a third and fourth polishing material, a polishing characteristic of said third polishing material being different than a polishing characteristic of said fourth polishing material, and a second polishing pad arranged into at least a third sector and a fourth sector, the third sector having the third polishing material and the fourth sector having the fourth polishing material.

9. The polishing apparatus of claim 8, wherein the polishing table rotates to selectively apply the first polishing pad or the second polishing pad to a surface of a semiconductor wafer.

10. The polishing apparatus of claim 8, wherein the polishing characteristics of the first polishing pad are different than the polishing characteristics of the second polishing pad.

11. The polishing apparatus of claim 8, further comprising:

a carrier for grabbing the semiconductor wafer.

12. The polishing apparatus of claim 11, including:

a carrier head for rotating the carrier and the semiconductor wafer.

13. The polishing apparatus of claim 8, wherein said first polishing pad has a first plurality of radial grooves that border said first and second sectors and said second polishing pad has a second plurality of radial grooves that border said third and fourth sectors.

14. The polishing apparatus of claim 7, further comprising:

a first sliding member within the first part for moving the first polishing pad in an up and down direction; and a second sliding m ember within the second part for moving the second polishing pad in an up and down direction.

* * * * *